US006457980B2

(12) United States Patent
Hattori et al.

(10) Patent No.: US 6,457,980 B2
(45) Date of Patent: Oct. 1, 2002

(54) PRINTED CIRCUIT BOARD CONNECTOR

(75) Inventors: Tetsuya Hattori, Aichi (JP); Yoshiaki Kato, Aichi (JP); Keiichi Ito, Aichi (JP); Kazuyuki Shiraki, Aichi (JP); Masanori Wakui, Aichi (JP)

(73) Assignee: Kabushiki Kaisha Tokai Rika Denki Seisa-Kusho, Aichi (JP)

( * ) Notice: Subject to any disclaimer, the term of this patent is extended or adjusted under 35 U.S.C. 154(b) by 0 days.

(21) Appl. No.: 09/855,742

(22) Filed: May 16, 2001

(30) Foreign Application Priority Data

May 16, 2000 (JP) ..... 2000-143305

(51) Int. Cl.[7] ..... H01R 12/00
(52) U.S. Cl. ..... 439/74; 439/246
(58) Field of Search ..... 439/246, 247, 439/248, 65, 79

(56) References Cited

U.S. PATENT DOCUMENTS 3,864,000 A * 2/1975 Coller et al. ..... 439/246
5,201,663 A * 4/1993 Kikuchi et al. ..... 439/83

* cited by examiner

*Primary Examiner*—Gary R. Paumen
*Assistant Examiner*—Ann McCamey
(74) *Attorney, Agent, or Firm*—Morgan, Lewis & Bockius LLP

(57) ABSTRACT

A connector housing (1) of a connector (1) is constituted by a lower housing (7), which is mounted on a printed circuit board (2), and an upper housing (8) connected to the lower housing (7) in such a manner as to be able to perform shifting movement with respect the housing (7). Further, terminals (6) are provided in such a way as to penetrate through a partitioning wall portion (8*a*) of the upper housing (8) and through a connecting block portion (7*b*) of the lower housing (7). At that time, tapered holes (7*d*) are provided in the connecting block portion (7*b*). The terminals (6) are maintained in a state in which a bending deformation thereof caused by the shifting movement of the upper housing (8) is allowed. Consequently, when the connector (1) is connected to the mating connector (3), the connectors (1, 3) can be connected to each other by performing the shifting movement of the upper housing (8) thereby to concurrently absorb the positional displacement therebetween. Moreover, occurrences of problems, such as breakage and bend of the terminals (6) at that time, are prevented.

10 Claims, 2 Drawing Sheets

PRINTED CIRCUIT BOARD CONNECTOR

BACKGROUND OF THE INVENTION

1. Technical Field of the Invention

The present invention relates to a printed circuit board connector, which is mounted on a printed circuit board and connected to a mating connector.

2. Related Art

For example, in a lever combination switch for use in a vehicle, two units (that is, printed circuit boards) are electrically connected to each other by using connectors. Hitherto, this has been performed by mounting male connectors on both the printed circuit boards, respectively, and then connecting the male connectors to each other by using a cable having both ends to which female connectors are respectively attached. However, in the related case of connecting the printed circuit boards by using such a cable, there are problems in that the number of man-hours required to assemble such parts into an apparatus is large, that moreover, the number of the parts is large, and that consequently, the assembling cost thereof is high.

Thus, there has been devised a method of mounting a male connector on one of the printed circuit boards and also mounting a female connector on the other printed circuit board and then directly connecting these connectors to each other. This enables the solution of the problems. However, this method causes problems that the positional displacement between the male and female connectors occurs owing to variation in assembling accuracy (that is, an assembling tolerance) in assembling the units (namely, the printed circuit boards), and that thus, the connection between the male and female connectors is not successfully established.

SUMMARY OF THE INVENTION

The invention is accomplished in view of the aforementioned circumstances. Accordingly, an object of the invention is to provide a printed circuit board connector enabled to be connected to a mating connector by absorbing the positional displacement between the connectors, which is caused owing to variation in assembling accuracy.

According to a first aspect of the invention, there is provided a printed circuit board connector which is mounted on a printed circuit board and detachably connected to a mating connector, the printed circuit board connector comprising:

a connector housing including a lower housing mounted on the printed circuit board, and an upper housing connected to the lower housing so as to allow shifting movement between the upper and lower housings; and at least one terminal, abase end of the at least one terminal supported by a supporting portion of the lower housing, a tip end of the at least one terminal is supported by a support portion of the upper housing, wherein the at least one terminal is held between the support portions of the upper and lower housings so that a bending deformation of the at least one terminal caused by the shifting movement is allowed.

According to a second aspect of the invention, in the printed circuit board connector of the first aspect, the mating connector mounted on another printed circuit board is connected to the upper housing to connect the printed circuit boards to each other.

According to a third aspect of the invention, in the printed circuit board connector of the first aspect, the supporting portion of the lower housing includes a tapered hole portion whose diameter gradually increases toward the upper housing for allowing the bending deformation.

According to a fourth aspect of the invention, in the printed circuit board connector of the first aspect, the upper housing includes an engaging hook, the lower housing includes an engaging concave portion engage able with the engaging hook, and a gap is formed between the upper and lower housing for allowing the shifting movement, when the engaging hook is engaged with the engaging concave portion.

According to the printed circuit board connector, the connector housing is divided into two members, that is, the lower housing, which is fixed to a printed circuit board, and the upper housing that is enabled to perform shifting movement with respect to the lower housing. Thus, even when there is some positional displacement between the printed circuit board connector and the mating connector, these connectors can be connected to each other by simultaneously absorbing the positional displacement therebetween by utilizing the shifting movement of the upper housing thereby to enable the absorption of the positional displacement therebetween.

At that time, in the connector housing, the terminal is provided in such a way as to extend over both the lower housing and the upper housing. Thus, there is a fear that the terminal is broken or bent by the shifting movement of the upper housing. However, the terminal is held between the supporting portions of both the lower housing and the upper housing in a state in which the bending deformation thereof is allowed. Consequently, occurrences of problems, such as breakage and bend of the terminals due to the bending deformation thereof, are prevented.

According to the second aspect, when the printed circuit boards are connected to each other, the circuit boards can be directly connected to each other by simultaneously absorbing the positional displacement between the connectors, which is caused owing to variation in assembling accuracy. Consequently, the number of man-hours required to assemble the parts is decreased. Moreover,the number of the parts is reduced. Thus, an inexpensive connecting structure is realized.

DETAILED DESCRIPTION OF PREFERRED EMBODIMENT

Figure 1:
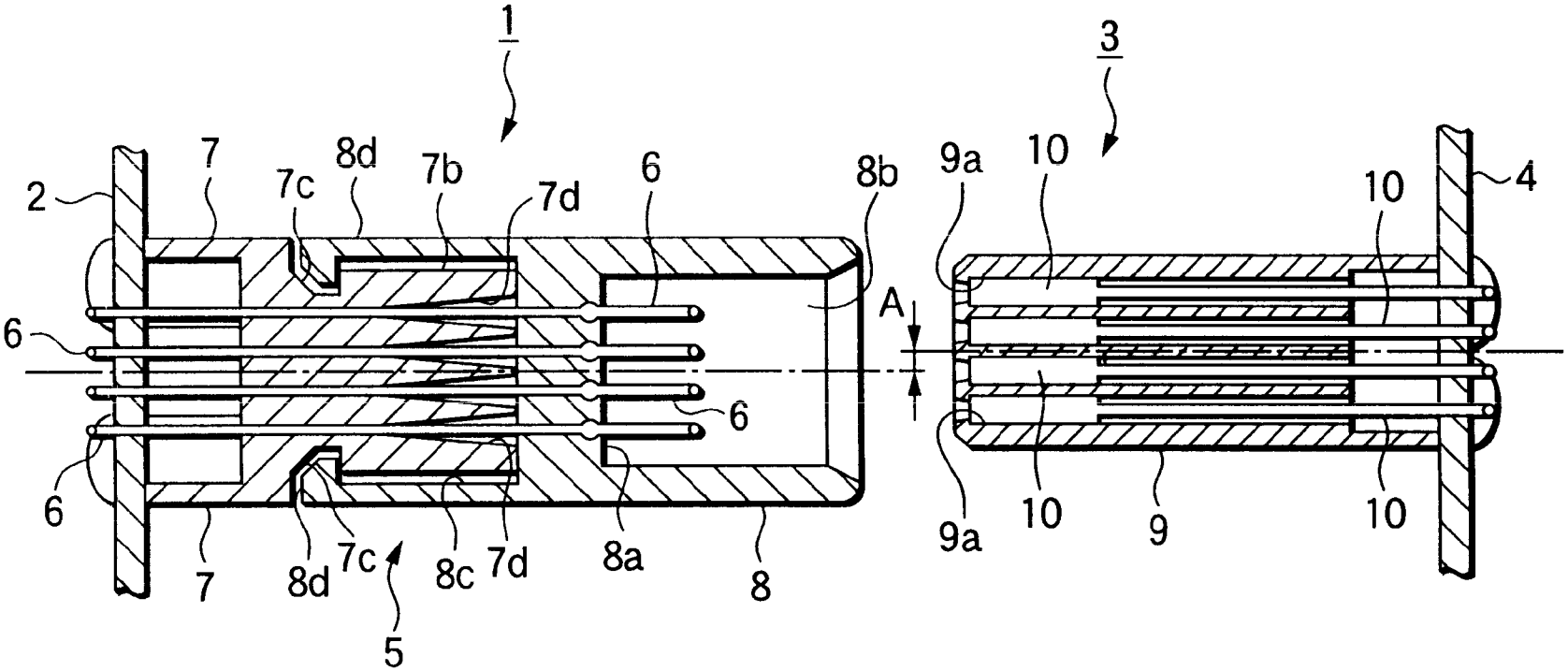
FIG. 1 is a view showing an embodiment of the invention, that is, showing the configurations of a connector and a mating connector, which are not connected to each other yet.
Figure 2:
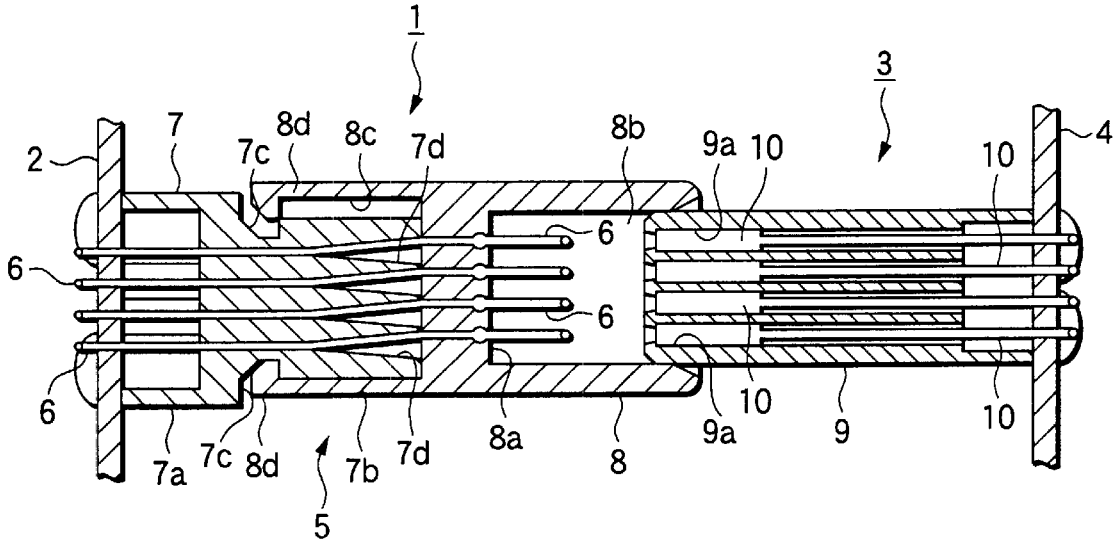
FIG. 2 is a view showing a manner in which the connector and the mating connector illustrated in FIG. 1 are connected to each other.

Hereinafter, an embodiment of the invention is described with reference to the accompanying drawings. FIGS. 1 and 2 are longitudinally sectional views illustrating a manner, in which a printed circuit board connector 1 according to the invention is mounted on a printed circuit board 2, and a manner, in which a mating connector 3 to be paired with the connector 1 is mounted on another printed circuit board 4. In this embodiment, the connector 1 is constituted as a male connector. Further, the mating connector 3 is constituted as a female connector.

The connector 1 according to this embodiment is configured by supporting a plurality of male terminals (in the case shown in the drawings, four male terminals) 6 in a connector housing 5 made of an insulating material (that is, a synthetic resin) At that time, the connector housing 5 is constituted by connecting two members into which the housing 5 is divided, that is, a lower housing 7 provided at the base side, namely, at the side to be mounted on the printed circuit board 2, and an upper housing 8 at the tip end side, namely, at the side to which the mating connector 3 is connected.

The upper housing 8 has a partitioning wall portion 8*a* provided in a middle portion thereof, and is formed like a rectangular box in such a manner as to be opened at both the lateral sides thereof, as viewed in the figures. A fitting concave portion 8*b*, into which the mating connector 3 is fitted, is formed as a distal end part (that is, a right-side one, as viewed in the figures) of portions partitioned by the partitioning wall portion 8*a* of the upper housing 8. Moreover, a connecting concave portion 8*c*, in which the leading end portion of the lower housing 7 is accommodated, is formed as a base end part (that is, a left-side one, as viewed in the figures) of portions partitioned by the partitioning wall portion 8*a* of the upper housing 8. Engaging hooks 8*d* are formed at the inner sides of the four-side wall of the base end part side (that is, the left end part, as viewed in the figures), which constitutes this connecting concave portion 8*c*, in such a way as to be integral therewith.

On the other hand, the lower housing 7 is formed like a rectangular box, whose base end portion (that is, the leftmost portion, as viewed in the figures) is opened, and has a base portion 7*a* mounted on the printed circuit board 2 to be placed thereon, and a rectangular-block-like connecting block portion 7*b* to be fitted into the connecting concave portion 8*c* of the upper housing 8. the base portion 7*a* and the connecting block portion 7*b* are formed integral with each other. Engaging concave portions 7*c*, each of which engages with a corresponding hook 8*d*, are formed in an outer surface part of this connecting block portion 7*b*.

With such a configuration, the connecting block portion 7*b* of the lower housing 7 is fitted into the connecting concave portion 8*c* of the upper housing 8. Each of the engaging hooks 8*d* is engaged with the corresponding one of the concave portions 7*c*. Thus, the lower housing 7 is connected to the upper housing 8, so that the connector housing 5 is constituted. At that time, small gaps are formed between the outer wall surface of the connecting block portion 7*b* and the inner wall surface of the connecting concave portion 8*c* in such a manner as to extend in upward and downward directions and in front ward and backward directions, as viewed in the figures. Thus, the upper housing 8 is enabled to perform the shifting movement with respect to the lower housing 7 in the upward or downward direction and in the front ward or backward direction by short distances (for instance, ±0.6 mm in each of both the directions).

Further, each of the terminals 6 is formed like a long pin extending in the lateral directions, and extends over both the upper housing 8 and the lower housing 7 and penetrates through the partitioning wall portion 8*a* and the connecting block portion 7*b*. At that time, through holes, into which the terminals 6 are press-fitted, are provided in the partitioning wall portion 8*a* that serves as a supporting portion for supporting the tip ends of the terminals 6. Incidentally, large-diameter portions of the terminals 6 are fitted into the right-side portions of these through holes.

On the other hand, through holes, through which a part including a middle portion to the base-side portion of each of the terminals penetrates, are provided in the connecting block portion 7*b*. These through holes have an inside diameter of a part, into which each of the terminals 6 is press-fitted, at the base side (that is, almost the left-side half, as viewed in the figures) of the connecting block portion 7*b* and serves as a supporting portion for supporting the base end of each of the terminals 6. Moreover, as viewed in the figures, almost the right-hand half of each of the through holes is formed as a tapered hole portion 7*d*, whose diameter gradually increases toward the leading end side (that is, the right side, as viewed in the figures). Thus, each of the terminals 6 is held between the supporting portion of the upper housing 8 and that of the lower housing 7 and maintained in a state in which a bending deformation is allowed, as illustrated in FIG. 2.

In this case, the terminals 6 are incorporated into the connector housing 5 by press-fitting each of the terminals 6 therein to from the upper housing 8 side (that is, the right side, as viewed in the figures) until the large-diameter portion of each of the terminals 6 is fitted into a corresponding one of the through holes of the partitioning wall portion 8*a*. Thus, the tip ends of the terminals 6 are arranged in proper positions along proper directions in the fitting concave portion 8*b*. Moreover, the base ends of each of the terminals 6 is placed in such a way as to leftwardly project from the base portion 7*a* of the lower housing 7 by a short length, as viewed in the figures.

Further, in the connector 1 configured in this manner, when the base portion 7*a* of the lower housing 7 is in a state that the portion 7*a* is mounted on the surface of the printed circuit board 2, the base end portion of each of the terminals 6 is inserted into a corresponding one of through holes of the printed circuit board 2 and then soldered to the back surface thereof. Incidentally, this printed circuit board 2 is incorporated into one unit of a lever combination switch for use in a vehicle. Generally, the lever combination switch is adapted so that a plurality of units are incorporated thereinto.

Furthermore, the mating connector 3 is configured in the female connector housing 9 in such a way as to support a plurality of terminals 10. A leading end side of the connector housing 9 (that is, a left side portion as viewed in the figures) is shaped like a rectangle and adapted to be fitted into the fitting concave portion 8*b* of the connector 1. Further, the connector housing 9 has insertion holes 9*a*, into which the tip end portions of the terminals 6 can be inserted, at the leading end portion thereof. The terminals 10 are adapted so that each of the tip end portions thereof is placed in a corresponding one of the insertion holes 9*a* and connected to a corresponding one of the terminals 6 and that the base-side portions (that is, the right-side portions, as viewed in the figures) thereof project from the connector housing 9.

When this mating connector 3 is mounted on the surface of the printed circuit board 4 by being put thereon, the base end portion of each of the terminals 10 is inserted into a corresponding one of the through holes of the printed circuit board 4 and then soldered to the back surface thereof. This printed circuit board 4 is also adapted to be inserted into another unit of the lever combination switch. The mating connector 3 is detachably connected to the connector 1. Thus, the connector 3 is electrically connected to the aforementioned unit(that is, the printed circuit board 2).

Meanwhile, in the aforementioned configuration, when the two units (that is, the printed circuit boards 2 and 4) are electrically connected to each other, the connector 1 is directly connected to the connector 3. At that time, there is a fear that a slight positional displacement (indicated by reference character A in FIG. A) in an upward or downward direction between the connector 1 and the mating connector 3 occurs owing to variation in assembling accuracy (that is, the assembling tolerance).

However, in this embodiment, in the connector 1, the upper housing 8 is enabled to perform the shifting movement with respect to the lower housing 7. Thus, even when there is some positional displacement between the connectors 1 and 3, the connection therebetween can be established by absorbing the positional displacement therebetween by utilizing the shifting movement of the upper housing, as illustrated in FIG. 2.

At that time, the terminals 6 in the connector housing 5 extends over the lower housing 7 and the upper housing 8. Thus, there is a fear that the terminals 6 are broken or bent as the shifting movement of the upper housing 8 is performed. However, the terminals 6 are held between the supporting portions of both the housings 7 and 8 and maintained in a state in which a bending deformation thereof is allowed by utilizing the tapered hole portions 7*d*. Therefore, since the bending deformation of the terminals 6 is caused due to the shifting movement of the upper housing 8, occurrences of problems, such as breakage and bend of the terminal 6 is prevented.

Thus, according to this embodiment, the printed circuit boards 2 and 4 can be directly connected to each other by such connectors 1 and 3. Thus, as compared with the related case of connecting the printed circuit boards by using a cable, the number of man-hours is decreased. Moreover, the number of parts is reduced. Consequently, an inexpensive connecting structure is realized. Further, the connector housing 5 of the connector 1 is constituted by the lower housing 7 and the upper housing 8, and the connector 1 is configured so that the bending deformation of the terminals 6 is allowed. Therefore, the printed circuit board connector of the invention has excellent effects of being connected to the mating connector 3 by simultaneously absorbing the positional displacement therebetween caused owing to variation in assembling accuracy.

Incidentally, although the connector 1 is configured as a male connector in the embodiment, the connector 1 may be constructed as a female connector. Even in this case, similar effects can be obtained by dividing the connector housing into two members, that is, the lower housing and the upper housing and by allowing the bending deformation of the terminals.

Additionally, various modifications of the connecting structure between the lower housing and the upper housing, and the structure for allowing the bending deformation of the terminals can be made. Further, the invention can be applied not only to the connection between the two units in the lever combination switch for use in a vehicle but to all the connections between various kinds of printed circuit boards. That is, the invention can be practiced by being suitably changed without departing from the gist thereof.

As is apparent from the foregoing description, according to the printed circuit board connector of the invention, the connector housing is constituted by the lower housing and the upper housing connected to the lower housing in such a manner as to perform the shifting movement. Moreover, the terminals are maintained in a state in which the bending deformation caused by the shifting movement of the upper housing. Thus, the printed circuit board connector of the invention has excellent effects of being connected to the mating connector by simultaneously absorbing the positional displacement therebetween caused owing to variation in assembling accuracy.

What is claimed is:

1. A printed circuit board connector which is mounted on a primary printed circuit board and detachably connected to a mating connector, the printed circuit board connector comprising:

a connector housing including a lower housing mounted on the printed circuit board, and an upper housing connected to the lower housing so as to allow shifting movement between the upper and lower housings;

at least one long pin-shaped terminal, a base end of the at least one terminal supported by a supporting portion of the lower housing, a tip end of the at least one terminal is supported by a support portion of the upper housing, wherein the at least one terminal is held between the support portions of the upper and lower housings so that a bending deformation of the at least one terminal caused by the shifting movement is allowed; wherein a mating printed circuit board is connected to the upper housing, the mating connector is mounted on the mating printed circuit board to connect the primary printed circuit board and the mating printed circuit board to each other;

the at least one long-pin-shaped terminal having a longitudinal axis; and the base end and the tip end are substantially aligned with each other along the longitudinal axis when there is no shifting movement between the lower housing and the upper housing.

2. The printed circuit board connector according to claim 1, wherein the supporting portion of the lower housing includes a tapered hole portion whose diameter gradually increases toward the upper housing for allowing the bending deformation.

3. The printed circuit board connector according to claim 1, wherein the upper housing includes an engaging hook, the lower housing includes an engaging concave portion engageable with the engaging hook, and a gap is formed between the upper and lower housing for allowing the shifting movement, when the engaging hook is engaged with the engaging concave portion.

4. The printed circuit board connector according to claim 1, wherein the upper housing further includes an external surface and an internal surface with an engaging hook;

the lower housing further includes an internal surface, and an external surface with an engaging concave portion; and the engaging concave portion is engage able with the engaging hook.

5. The printed circuit board connector according to claim 1, wherein the hook engages with the engaging concave portion when the upper housing engages with the lower housing.

6. The printed circuit board connector according to claim 1, wherein the upper housing includes a hook end and a tapered hole end;

the terminal support portion is located between the hook end and the tapered hole end; and the terminal support portion includes one orifice for each terminal.

7. A printed circuit board connector which is mounted on a primary printed circuit board and detachably connected to a mating connector, the printed circuit board connector comprising:

a connector housing including a lower housing mounted on the printed circuit board, and an upper housing connected to the lower housing so as to allow shifting movement between the upper and lower housings;

at least one terminal, a base end of the at least one terminal supported by a supporting portion of the lower housing, a tip end of the at least one terminal is supported by a support portion of the upper housing, wherein the at least one terminal is held between the support portions of the upper and lower housings so that a bending deformation of the at least one terminal caused by the shifting movement is allowed;

wherein the terminal is long-pin shaped along a substantially straight axis;

the at least one terminal further includes a printed circuit board end engaged with the printed circuit board; and the printed circuit board end, the base end and the tip end are substantially aligned with each other along the straight axis when there is no shifting movement between the lower housing and the upper housing.

8. The printed circuit board connector according to claim 7, wherein the mating connector is mounted on a mating printed circuit board connected to the upper housing to connect the primary printed circuit board and the mating printed circuit board to each other.

9. The printed circuit board connector according to claim 7, wherein the supporting portion of the lower housing includes a tapered hole portion whose diameter gradually increases toward the upper housing for allowing the bending deformation.

10. The printed circuit board connector according to claim 7, wherein the upper housing includes an engaging hook, the lower housing includes an engaging concave portion engageable with the engaging hook, and a gap is formed between the upper and lower housing for allowing the shifting movement, when the engaging hook is engaged with the engaging concave portion.

* * * * *